US005664725A

United States Patent [19]

Walz

[11] Patent Number: 5,664,725

[45] Date of Patent: *Sep. 9, 1997

[54] MAILING FORM

[75] Inventor: Gerard F. Walz, Fallbrook, Calif.

[73] Assignee: Walz Postal Solutions, Inc., Fallbrook, Calif.

[ * ] Notice: The term of this patent shall not extend beyond the expiration date of Pat. No. 5,501,393.

[21] Appl. No.: 610,497

[22] Filed: Mar. 4, 1996

Related U.S. Application Data

[63] Continuation-in-part of Ser. No. 227,513, Apr. 14, 1994, Pat. No. 5,501,393.

[51] Int. Cl.[6] ..... B65D 27/06

[52] U.S. Cl. ..... 229/92; 229/92.8; 229/300; 40/638

[58] Field of Search ..... 229/92.8, 300, 229/92; 40/638

[56] References Cited

U.S. PATENT DOCUMENTS

| | | | |
|---|---|---|---|
| 2,805,816 | 9/1957 | Morgan | 229/92.8 |
| 3,312,005 | 4/1967 | McElroy | 40/638 |
| 3,655,121 | 4/1972 | Ward . | |
| 3,937,492 | 2/1976 | Biron . | |
| 3,968,927 | 7/1976 | Katz et al. . | |
| 4,029,341 | 6/1977 | Neill et al. . | |
| 4,277,089 | 7/1981 | Lockhart . | |
| 4,368,903 | 1/1983 | Jones . | |
| 4,418,865 | 12/1983 | Bowen . | |
| 4,429,827 | 2/1984 | Murray . | |
| 4,460,676 | 7/1984 | Fabel . | |
| 4,461,661 | 7/1984 | Fabel . | |
| 4,598,860 | 7/1986 | Pennock . | |
| 4,598,935 | 7/1986 | Stewart . | |
| 4,614,361 | 9/1986 | Foster . | |
| 4,682,793 | 7/1987 | Walz . | |
| 4,706,878 | 11/1987 | Lubotta et al. . | |
| 4,778,153 | 10/1988 | Bachman et al. | 229/92.8 X |
| 4,781,322 | 11/1988 | Humm | 229/300 X |
| 4,784,317 | 11/1988 | Chen et al. . | |
| 4,809,905 | 3/1989 | Goodman | 229/92.1 X |
| 4,898,323 | 2/1990 | Chen et al. . | |
| 4,944,449 | 7/1990 | Schmidt . | |
| 4,978,146 | 12/1990 | Warther et al. . | |
| 4,995,642 | 2/1991 | Juszak et al. . | |
| 5,007,191 | 4/1991 | Klein | 40/639 |
| 5,011,559 | 4/1991 | Felix . | |
| 5,031,382 | 7/1991 | Boyle . | |
| 5,071,167 | 12/1991 | O'Brien . | |
| 5,098,759 | 3/1992 | Felix . | |
| 5,104,036 | 4/1992 | Rutkowski . | |
| 5,129,682 | 7/1992 | Ashby . | |
| 5,154,344 | 10/1992 | Loch . | |
| 5,169,060 | 12/1992 | Tighe et al. . | |
| 5,183,203 | 2/1993 | Sanders . | |
| 5,190,210 | 3/1993 | Walz . | |
| 5,209,514 | 5/1993 | Hebert . | |
| 5,211,434 | 5/1993 | Reese . | |
| 5,267,898 | 12/1993 | Doll et al. . | |
| 5,316,208 | 5/1994 | Petkovsek . | |
| 5,318,324 | 6/1994 | Lombardo et al. . | |
| 5,397,052 | 3/1995 | Walz . | |
| 5,507,526 | 4/1996 | Petkovsek . | |
| 5,573,277 | 11/1996 | Petkovsek . | |

FOREIGN PATENT DOCUMENTS

| | | | |
|---|---|---|---|
| 1030577 | 10/1972 | Canada . | |
| 4-324487 | 11/1992 | Japan | 40/639 |
| 4-324482 | 11/1992 | Japan | 40/639 |

*Primary Examiner*—Jes F. Pascua
*Attorney, Agent, or Firm*—Brown, Martin, Haller & McClain

[57] ABSTRACT

A multi-part mailing form has two superimposed sheets of material such as paper stock which are secured together in adhered areas by an adhesive layer between the sheets. The inner face of a lower sheet is coated with a non-adhesive material in certain areas so that the sheets are not adhered in these areas. The coated areas of the lower sheet correspond to detachable areas of the upper sheet which can be detached and secured to an item to be mailed. Sections of the form are separable from one another by cutting or by means of tear lines. One of the separable sections has imprinted indicia on the outer face of each sheet and includes a return postcard for confirming receipt of a mailed item.

22 Claims, 6 Drawing Sheets

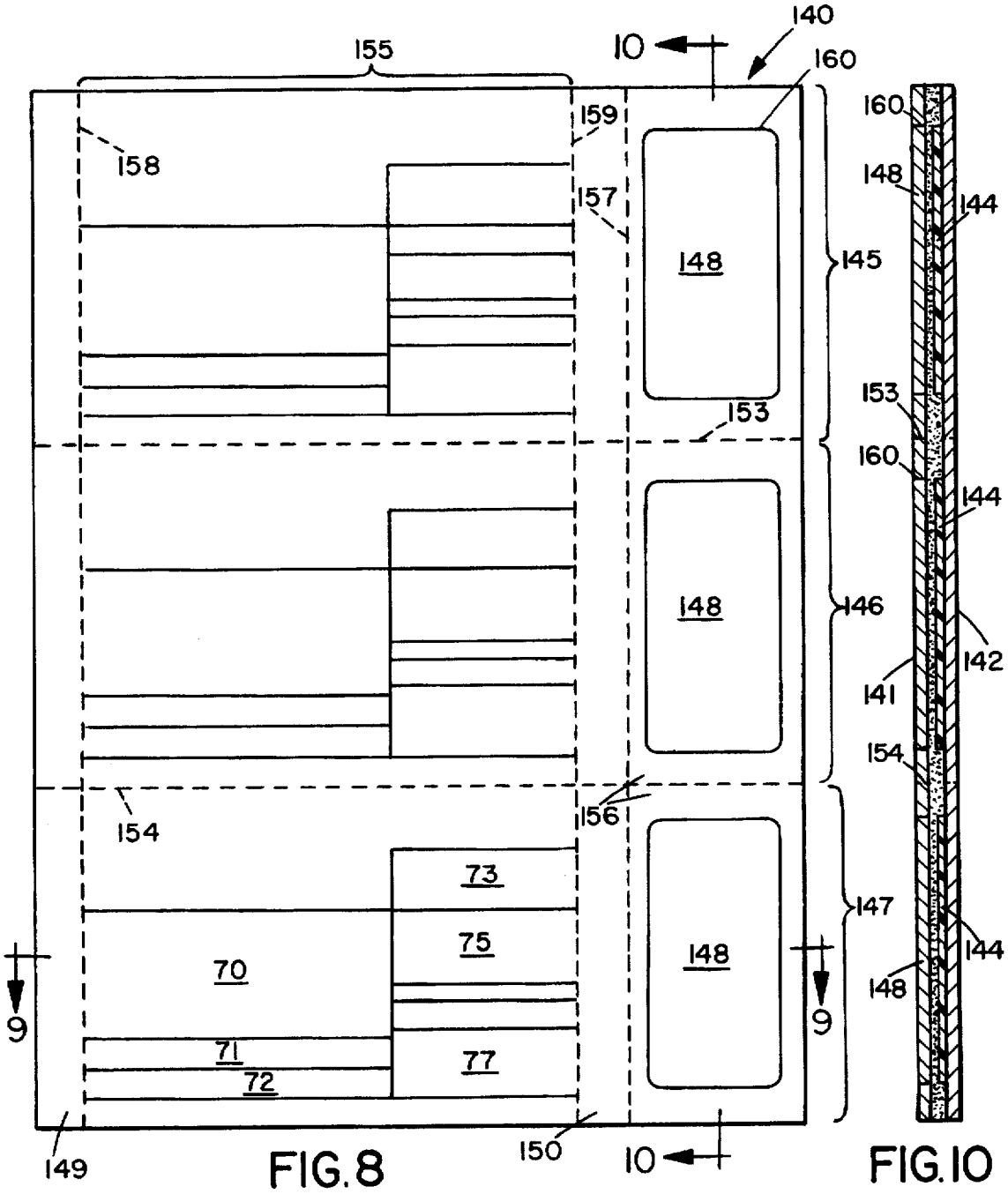
FIG.8
FIG.10
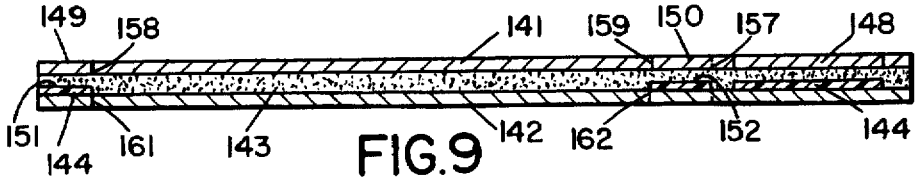
FIG.9

MAILING FORM

CROSS-REFERENCES TO RELATED APPLICATIONS

This application is a continuation-in-part of application Ser. No. 08/227,513 filed Apr. 14, 1994, now U.S. Pat. No. 5,501,393.

BACKGROUND OF THE INVENTION

The present invention relates generally to multi-part mailing forms for use by businesses in mailing items to various customers or clients and in keeping records of such mailings, and is particularly concerned with forms for use in certain specific types of mailing such as certified and registered mail procedures.

In my U.S. Pat. No. 4,682,793 a mailing form is described which is designed to meet U.S. Post office certified mail requirements. The form has multiple layers which include all the paperwork necessary to prepare a mailing label, customer receipt and return receipt for each item mailed. A series of forms can be run through a printer to provide paperwork for certified mailing of a plurality of items, considerably reducing the time and effort required for such mailings in a typical business environment.

My U.S. Pat. No. 5,190,210 describes another multi-part mailing form which is a single sheet with detachable areas corresponding to various forms for use in certified, registered and other special types of mailing services. The forms include an addressee region with a blow on label, a detachable identifying number label, and a detachable return postcard. This form is suitable for registered mailing and similar procedures, and can be used in an automated mailing preparation system using a computer to print a series of forms.

One problem with previous registered mailing forms is that the return postcard is normally of relatively thick card stock which may not be suitable for all printer feeds, such as laser printers, for example. However, paper stock is typically too thin to meet Post Office requirements for return receipt postcards, which must normally be of the order of around 9 mil. thickness.

SUMMARY OF THE INVENTION

It is an object of the present invention to provide a new and improved mailing form.

According to the present invention, a mailing form is provided which comprises two sheets of material, preferably paper stock, each sheet with an inner face facing the other sheet and an outer face, a first one of the sheets having a plurality of detachable areas which are detachable from the remainder of the first sheet, an adhesive layer between the sheets for permanently securing the sheets together over predetermined, adhered areas of the form, the second sheet having a non-adhesive coating on its inner face in predetermined, non-adhered areas which are aligned with the detachable areas so that the detachable areas do not adhere to the second sheet, one of the predetermined, adhered areas of the form where the sheets are permanently secured together comprising a detachable form part, each sheet having predetermined printed indicia on its outer face in said one predetermined, adhered area corresponding to the detachable form part.

In the preferred embodiment of the invention, the predetermined, adhered area comprises a return postcard for confirmation of receipt of a mailed item, and the predetermined indicia include marked areas for receiving predetermined information concerning a mailed item, one of the marked areas on the outer face of one of the sheets comprising a designated addressee area for receiving the address to which the item is to be mailed and another of the areas on the outer face of the other sheet comprising a return address area for receiving the address of the sender of the item. The two sheets have a predetermined combined thickness corresponding to Post Office minimum thickness requirements for return postcards associated with various mailing procedures, such as certified and registered mail. The two sheets may be of equal thickness, or one may be thicker than the other.

Preferably, the detachable areas in the first sheet include labels which are die cut around at least the majority of their periphery for easy detachment from the remainder of the form. The detachable label areas may include at least one blank address label on which an address may be imprinted prior to detachment from the form and attachment to an item to be mailed. Additional blank address labels may be provided for records purposes and for attachment to other items to be mailed, such as a simultaneous mailing of the same item by both certified and regular first class mail.

The form also includes an imprinted receipt area which can be detached from the remainder of the form, and an imprinted identifying label carrying an item number for the item being mailed, for use in tracking the item.

This form can be used in laser printers and avoids the problems of using card stock as part of a form in such printers. The form is relatively inexpensive and is both convenient and easy to use both in preparing items for procedures such as certified mailing and in providing hard copy records of such mailings.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which:

FIG. 8 is a top plan view of a form according to a third embodiment of the invention;

FIG. 9 is a section on the lines 9—9 of FIG. 8;

FIG. 10 is a section on the lines 10—10 of FIG. 9;

DESCRIPTION OF THE PREFERRED EMBODIMENTS

FIGS. 1–5 of the drawings illustrate a single, multi-part mailing form 10 for use in mailing and record keeping procedures, such as certified or registered mail. The form 10 may be provided in a single sheet format as illustrated, or as a continuous length of forms 10 detachably secured together via transverse lines of perforations between adjacent form lengths, depending on the type of printer to be used. A single sheet format is typically used for laser printers.

Figure 1:
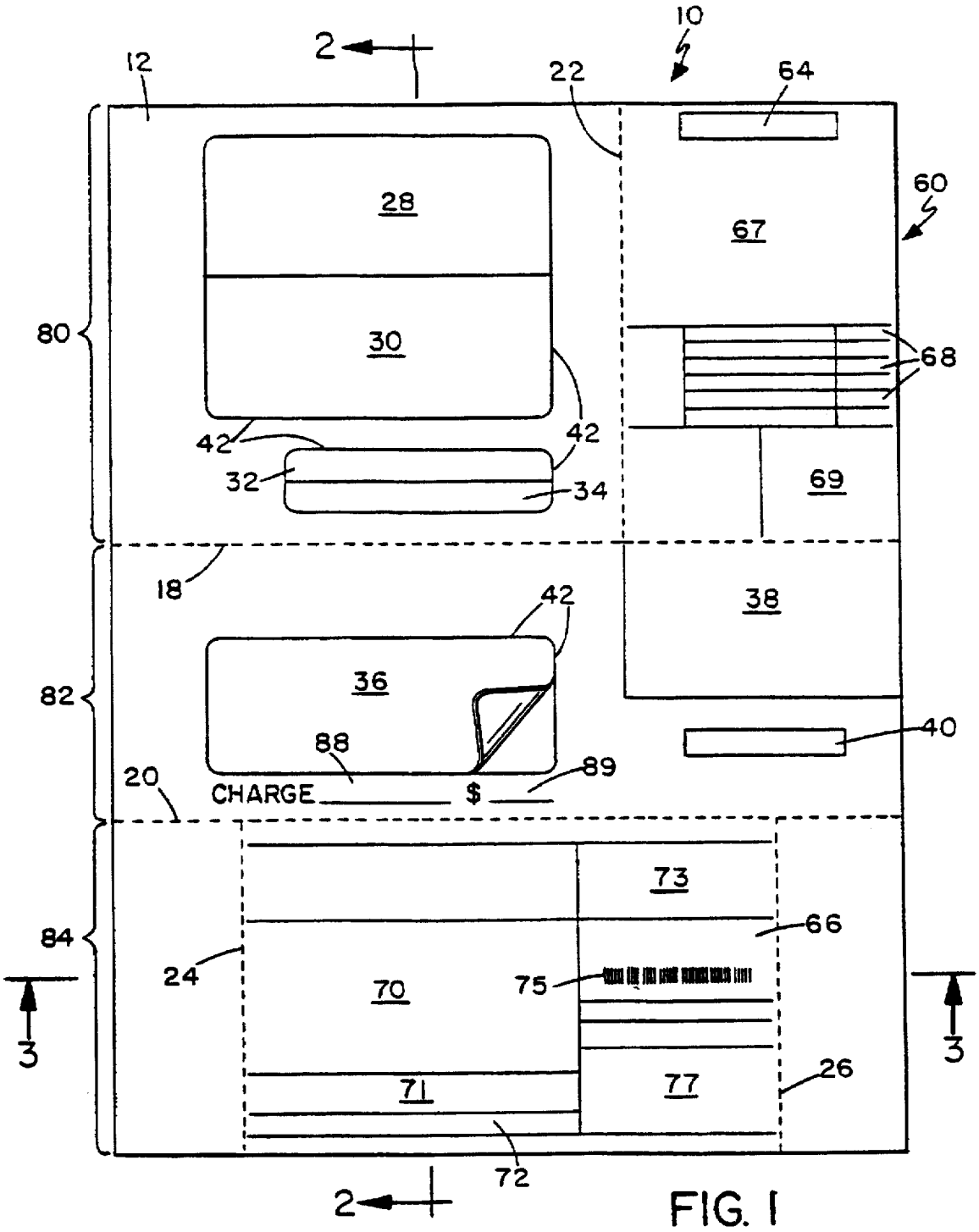
FIG. 1 is a top plan view of a form according to a first embodiment of the invention.
Figure 3:
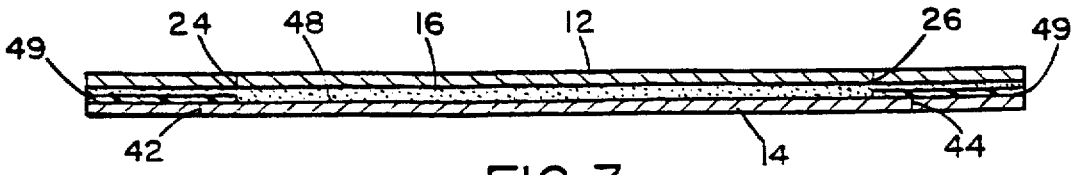
FIG. 3 is a section on the lines 3—3 of FIG. 1.
Figure 2:
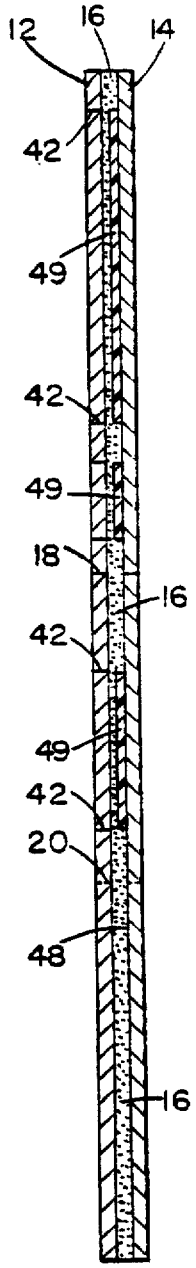
FIG. 2 is a section on the lines 2—2 of FIG. 1.

The form comprises two sheets of relatively thin sheet material such as paper stock or lightweight card stock such as a lightweight tag. Upper sheet 12 and lower sheet 14 have an adhesive layer 16 between them for adhering the upper sheet to the lower sheet in certain areas, as best illustrated in FIGS. 2 and 3. The upper sheet may be paper and the lower sheet card, or vice versa, or both sheets may be paper. Transversely and longitudinally extending lines of perforations 18,20,22,24 and 26 extend through both sheets for separating the form into various form parts. Transverse lines 18 and 20 separate the form into three basic sections, 80,82 and 84. Additionally, the upper sheet has detachable label areas 28,30,32,34,36,38 and 40 which are die cut along die cut lines 42 extending around all or part of their respective peripheries, as illustrated in FIGS. 1, 2 and 3. The lower sheet has a pair of die cut lines 44,46 extending parallel to but spaced from the perforated lines 24 and 26.

Figure 4:
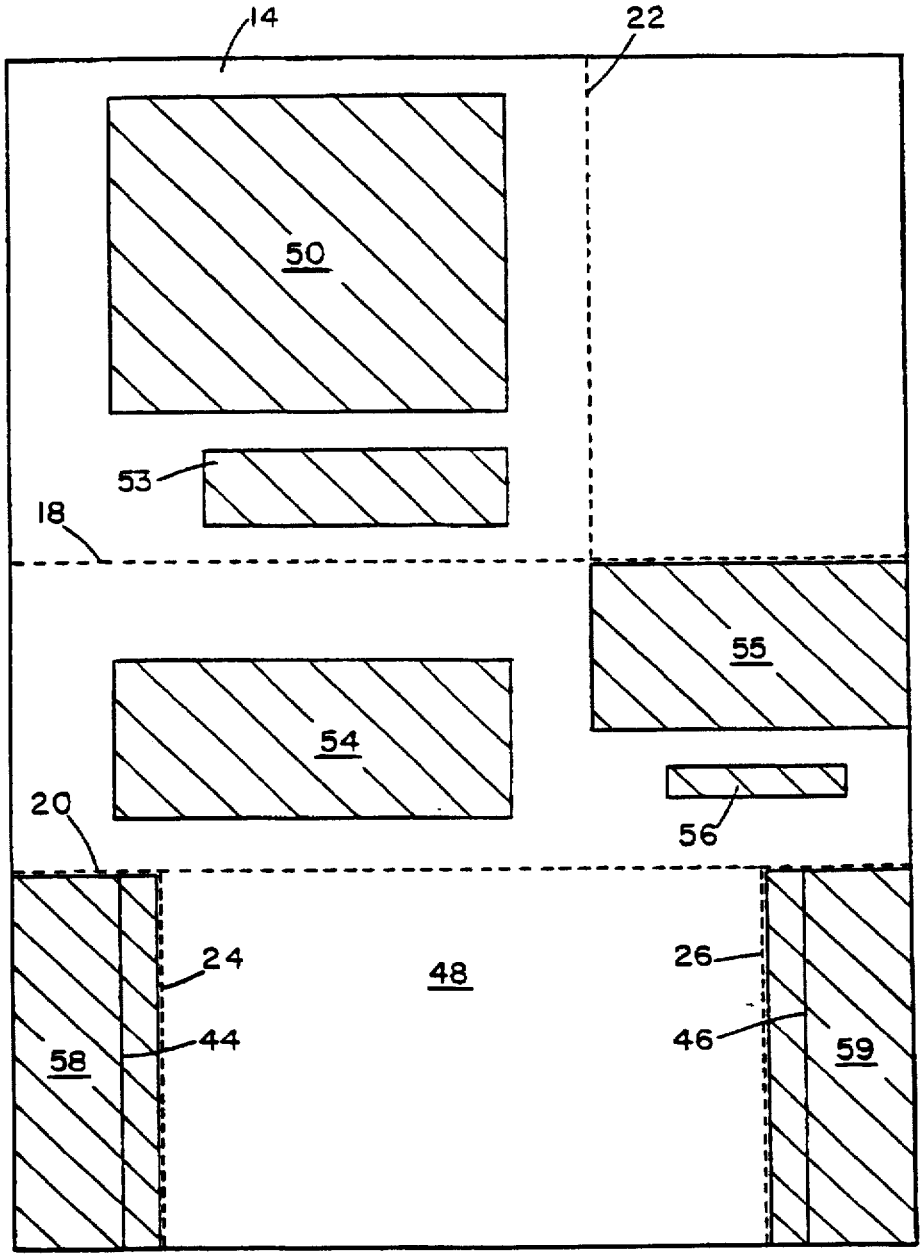
FIG. 4 is a top plan view of the inner face of the lower sheet of the form.

As best illustrated in FIGS. 2–4, the inner surface 48 of the lower sheet is treated or coated in certain areas 50,53, 54,55,56,58 and 59 with a non-adhesive or so-called release coating material 49 such as silicone gel material, which prevents the lower sheet from strongly adhering to the upper sheet in these areas. Area 50 corresponds with the two label areas 28 and 30, and area 54 corresponds to label area 36 of the upper sheet. Non-adhesive area 53 corresponds to the two label areas 32 and 34 of the upper sheet. Areas 55 and 56 correspond to the label areas 38 and 40, respectively. Non-adhesive area 58 extends from perforated line 24 out to the outer edge of the sheet, and from perforated line 20 down to the lower edge of the sheet. Similarly, non-adhesive area 59 extends from perforated line 26 out to the outer edge of the sheet and from line 20 down to the lower edge of the sheet. Thus, the upper and lower sheets adhere together permanently in all regions of the lower sheet which are not treated with non-adhesive material.

Figure 5:
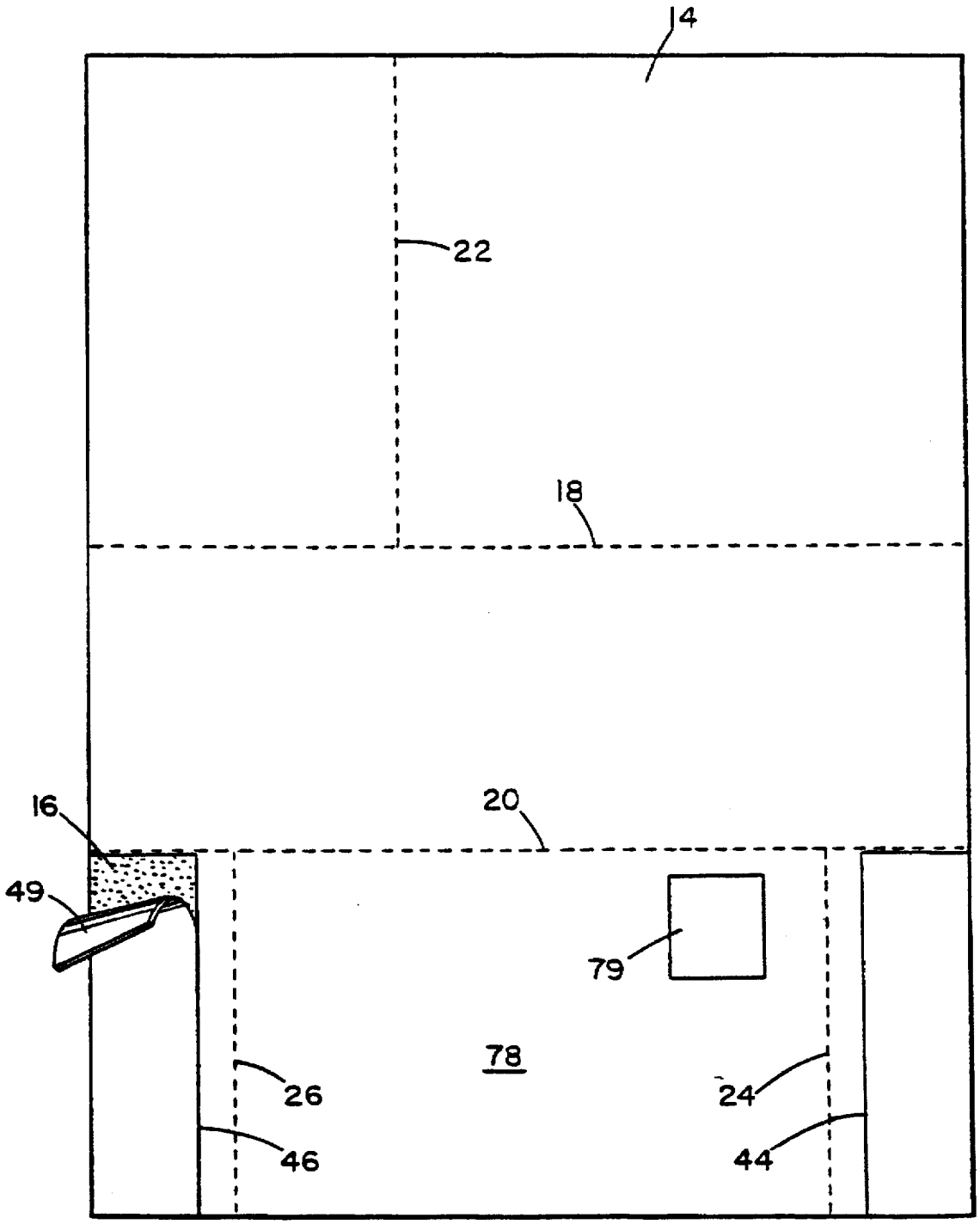
FIG. 5 is a plan view of the rear face of the form.

The adhesive material between the sheets is preferably a pressure sensitive adhesive which adheres the sheets together where the lower sheet has not been coated with non-adhesive material. All of the label areas can be detached or peeled away from the remainder of the form via the die cut lines, since they will not be adhered, or will adhere only lightly, to the lower sheet. The corner of label area 36 is shown partially peeled away from the remainder of the form in FIG. 1, for example. The undersurface of the label area 36 will be coated with adhesive material 16 and will not be adhered to the underlying non-adhesive material 49 coating the underlying area 54 of the lower sheet. All label areas can be peeled away from the form in a similar manner as needed. Additionally, side strips of the lower sheet outside die cut lines 44 and 46 can also be peeled away from the upper sheet, as indicated in FIG. 5.

Some of the label areas and some other regions of the form are blank for user entry of information via a laser printer or the like hooked up to a computer having a database of customer or client information, for example. Thus, label 28 is blank and comprises an address label for receiving an address to which an item is to be mailed. Label 30 comprises another blank address label for receiving the same address. This can be used in those situations where the same item of mail is to be sent in two different ways, for example via both certified mail and via first class mail. Another blank address label 36 can be used for keeping records of items mailed, for example in a postal log book or U.S. Postal Service (USPS) Firm Mailing Book (3877). This label can be detached and adhered to the Firm Mailing Book at the mailing center, as a record of the mailing.

Other label areas carry pre-printed indicia. Label 38 carries an article number for use by the Post Office in mail tracking. Preferably, the label is the article number label of the required Post Office format and backing color for that particular service (e.e. green for certified mail). However, other formats may be used for alternative mailing procedures. The same article number is imprinted on the small label strip 40, and is also imprinted on the lower section 84 of the form, in region 66, and on a detachable part 60 of the form, in region 64. Form part 60 is detachable from the remainder of the form via lines of perforations 18 and 22 and is of two sheet thickness, consisting of equivalent parts of both sheets adhered together via adhesive material 16. Detachable two sheet part 60 has the format of a Post Office certified mail receipt form, such as PS Form 3800, and includes a blank area 67 for entering the addressee/reference information, and areas 68 for entry of various postal fees, as well as a postmark receiving area 69 as confirmation of mailing.

The entire lower section 84 of the form below perforated line 20 comprises a return postcard of the type which is attached to an item to be mailed until received by the addressee, and then returned to the sender as confirmation of receipt. The Post Office has typically required that such return postcards be of card stock having a thickness of 0.009 inches, which is difficult or impossible to use in modern printers such as laser printers. However, new Post Office regulations indicate that a minimum thickness of 0.007 inches may be sufficient in some cases. By forming the return postcard of two sheets of paper which are bonded together, it will have sufficient strength and thickness to meet Post Office requirements for return postcards in most cases. At the same time, there will be no restriction on the type of printer and the form can be completed using a laser printer.

In the illustrated embodiment, detachable section 84 comprises a Post Office return receipt form PS 3811. The front sheet of section 84 includes various pre-printed regions between perforated lines 24 and 26. These comprise an area 70 for receiving the address to which the item is to be mailed, as well as areas 71,72 for receiving signatures of the addressee and agent, area 73 for indicating other services requested, such as addressee's address and restricted delivery, area 66 carrying the article number in OCR-A font and a corresponding bar coded article number 75, area 76 for entering the date of delivery, and area 77 for entering a new address if the addressee has moved and this service has been requested and paid for. The regions outside lines 24 and 26 may be blank or may contain other pre-printed information.

As best illustrated in FIG. 5, the rear face of the form part or section 84 includes a return address area 78, which is preferably pre-printed with the user's address, between lines 24 and 26, as well as a pre-printed postal indicia area 79 in the upper right-hand corner. Where the return address is not pre-printed, one of the three address labels may be printed with the return address and affixed to region 78. As has been noted above, the front sheet and rear sheet are only adhered together in the return postcard part of the form in the region between tear lines 24 and 26. The two side portions outside this area are not adhered together. Strips of the rear sheet portion of the form outside die cut lines 44 and 46 can therefore be peeled away, as indicated in FIG. 5, in order to expose the adhesive layer 16 on the rear surface of the front sheet. This leaves two exposed strips of adhesive on each side of the return postcard, by postcard of which the return postcard can be adhered to an item to be mailed.

The upper section 80 of the form is separable along tear line 18 and includes the addressee labels 28 and 30, two smaller labels 32 and 34 for attachment to an envelope or other piece of mail when certain specialized services are requested and paid for, and a receipt 60 for proof of certified mailing. Label 32 may be imprinted with the words "addressee's address," for example, and is attached to an item of mail when the sender has requested and paid for information regarding an addressee's new address when a mail forwarding order has been placed. Label 34 may be imprinted with the words "restricted delivery" for use when an item of mail is to be given to the addressee only, and not to any other individual who may reside at the same address. The appropriate boxes will be checked in region 73 of the return postcard 62 when either of these services is to be used.

The central section 82 of the form carries the certified mail number label 38, as well as addressee label 36 for use by the sender as a mailing record, and a small strip label 40 which carries the same mail item number as label 38. Label 40 may be used in a number of ways. For example, it may be affixed to a copy of the letter sent, attached to the USPS Firm Mailing Book adjacent the address label 36, or used to identify an item for charge back purposes. Section 82 of the form is designed so that it may be used for charging back postage to a customer. It includes a blank area 88 for entry of the name of the person or entity to be charged, and a blank area 89 for entry of the total postage and fees for mailing the item. If this section is to be used for charge back, the entire section is detached from the remainder of the form after the blank areas of the form have all been completed, and section 82 is then forwarded to the billing department for billing to the client or customer.

As noted above, the lower section 84 of the form is the return postcard for signature by the addressee on delivery. After signature, the central portion of the form is detached along lines 24 and 26 and mailed back to the sender in the usual way.

Each sheet 12 and 14 is preferably of paper stock and the two sheets have a combined thickness of 0.007 to 0.010 inches, depending on Post Office rules regarding the minimum thickness for return postcards used in certified and registered mailing and the like. The sheets may be of equal thickness, for example each may be of 0.0045 inch paper stock, or one sheet may be thicker than the other. The label carrying front or top sheet 12 may be thinner than the rear sheet, for example, so that the rear sheet is heavier and provides support for the removable labels. The ratio in thickness may be 40% for the top sheet and 60% for the bottom sheet, for example, depending on printer requirements. Alternatively, the top sheet may be thicker, providing thicker labels and reducing the tendency of labels to curl when peeled off.

The die cut lines for allowing the labels to be separated from the remainder of the form may have ties or unscored regions in their length to ensure that the labels do not separate in the printer and cause a paper jam. This is achieved by providing indents or cut outs in the knife edge for scoring the paper, the indents having a depth equal to the paper thickness, so that the die cut lines will have short gaps or uncut portions in their length. The tear lines and die cut lines are cut after the two sheets have been secured together via the adhesive layer.

The procedure for using forms 10 in a mailing preparation system using a computer and single sheet printer such as a laser printer will now be described in more detail. A stack of forms 10 will first be loaded into the printer. The user then enters a list of names and addresses to which items are to be mailed, either manually via the computer keyboard or using a previously created data base. The various postage fees depending on weight of the items to be mailed and the type of postage service or services requested may also be entered manually at the keyboard or via a previously created database. The computer will be programmed to enter the first name and address on blank labels 28,30 and 36 as well as in the blank area 70 of the return postcard if desired, an account number may also be entered on each address label. The computer will also be programmed to enter the various postage fees in areas 68 of the receipt portion of the form, depending on the selected services and item weight, and to mark the relevant boxes in region 73 of the return postcard part of the form if the associated services are to be requested. The computer is also programmed to fill out charge back information in section 82 of the form if this section is to be used for accounting purposes. The same procedure is carried out for subsequent forms in the stack.

Once the forms are completed, each form is used for mailing an item as follows. First, the address label 28 is peeled off the form and adhered to the item to be mailed. If a confirmation copy of the letter or item is to be sent via regular first class mail, address label 30 is detached and adhered to the envelope containing the confirmation copy. Preferably, the receipt 60 and mail number label 38 are detached together from the form, by peeling label 38 away from the rear sheet and detaching receipt 60 along tear line 22 of both the front and rear sheets and along tear line 18 of the rear sheet only. Thus, label 38 remains attached to the receipt 60 along tear line 18 of the front sheet. The label 38 is then adhered to the item to be mailed along with the receipt 60 for easy transport to the Post Office for date stamping.

The return postcard is detached from the remainder of the form along tear line 20. Strips of the rear sheet outside die cut lines 44,46 are then peeled away, as indicated in FIG. 5, and the postcard is adhered to the item to be mailed via the exposed marginal regions of adhesive 16 underneath the removed strips. If the optional services identified in labels 32 and/or 34 are to be used, these labels are also peeled away and attached to the item to be mailed.

The central portion 82 of the form is then detached from the remaining part of the top portion 80 along tear line 18. The remaining part of top portion 80 can be discarded. The central portion can be used optionally for a mailing record in a postal log book or USPS "Firm Mailing Book" (3877), or for charging postal fees to a client. In the former case, the portion 82 is clipped to the item to be mailed via a paper clip or the like, and the completed item is sent to the mail room. Mail room personnel can then peel away labels 36 and 40 and attach them to the Postal Log Book as a record of mailing.

Alternatively, where portion 82 is to be used for billing purposes, the "Charge To" and "$" fields are filled in by the sender, and this portion is then sent to the billing department for appropriate processing.

The item is then ready for mailing. At the Post Office, the receipt 60 will be date stamped in area 69 with the date delivered to the post office, and will then be removed from the certified mail label via perforated line 18 and returned to the sender for proof of delivery into the postal system.

When the item is delivered to the addressee, the addressee signs the return postcard in area 71, and the postal service agent signs in area 72. The postcard is then removed from the item via tear lines 24 and 26, and returned to the sender as confirmation of receipt of the item by the addressee.

Figure 6:
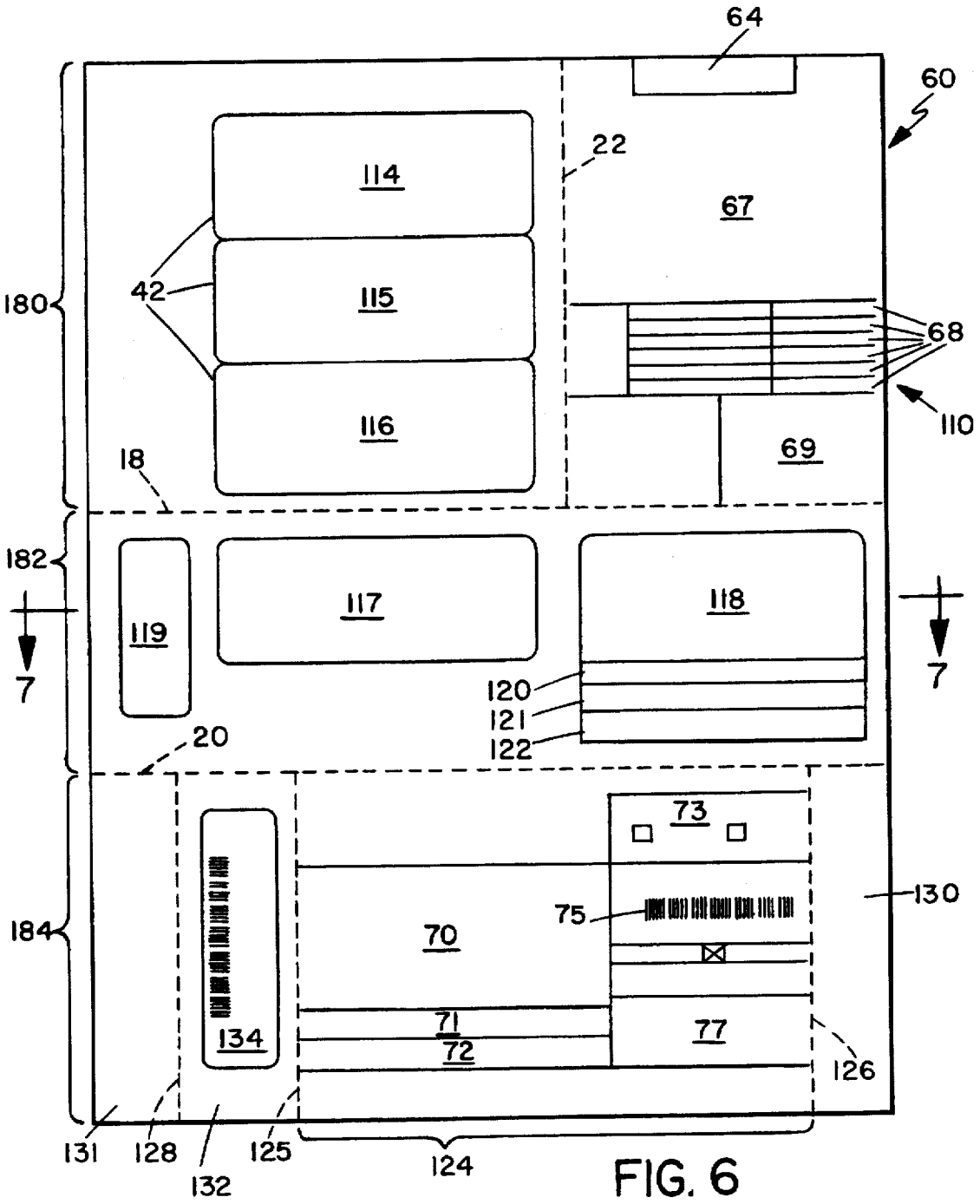
FIG. 6 is a top plan view of a form according to a second embodiment of the invention.
Figure 7:
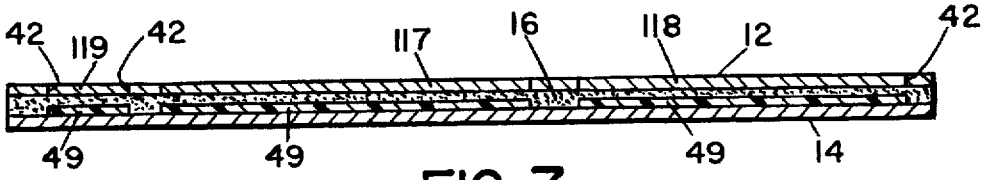
FIG. 7 is a section on the lines 7—7 of FIG. 6.

FIGS. 6 and 7 illustrate a modified, multi-part mailing form 110 according to a second embodiment of the invention. This form is similar to that of FIGS. 1–5, and like reference numerals have been used for like parts as appropriate. However, the labels are arranged differently and the form has a lower, return receipt portion with an extra side portion and label, as explained in detail below.

As in the first embodiment, the form 110 comprises two sheets 12,14 of relatively thin sheet material such as paper stock or lightweight card stock which does not exceed the maximum thickness for a laser printer. Upper sheet 12 and lower sheet 14 have a layer 16 of adhesive between them for permanently adhering the upper sheet to the lower sheet in some areas, such as the receipt portion 69 in the upper right-hand corner of the form. Transverse lines 18 and 20 separate the form into three basic sections 180,182 and 184, as in the first embodiment. Lines 18 and 20 may be lines of perforations, as illustrated. Alternatively, the form may be separated into three parts by an automatic cutting and stacking machine, such as the Speedy Cutter of Moore, Inc., in which case it need not have lines of perforations, but will simply be cut along the lines 18 and 20 automatically after printing is complete.

The upper sheet has certain detachable label areas which are aligned with corresponding areas of the lower sheet which are coated with a suitable non-adhesive release coating material 49 such as silicone gel material or the like, which prevents adhesive 16 from adhering to the lower sheet. The label areas differ from the first embodiment, and include three identical address label areas 114,115,116 in the upper portion 180 of the form. The middle portion 182 of the form includes an address label 117, a first label 118 carrying the Post Office article number for attaching to an item of mail in the conventional manner, a second label 119 carrying the same number for the sender's records, and three narrow labels 120,121,122 carrying informational indicia such as "Return Receipt Requested", "Addressee's Address" and "Restricted Delivery", for informing the post office carrier of the conditions under which the item is to be delivered. The first label 118 may also be imprinted with a patch of suitable identifying compound or ink, such as taggant ink, which can be used in automatic mail sorting machines to pick out certified mail items.

The lower, return receipt portion 184 differs slightly from portion 84 of the first embodiment since the return postcard portion 124 between tear lines 125,126 is not centrally positioned, but is offset to one side of the form, so that the section to the left of tear line 125 is wider than the strip or section of the right of tear line 126. The return postcard portion has the same printed indicia and sections 70,71,72, 73,75 and 77 as in the first embodiment. An additional vertical tear line 128 is provided between tear line 125 and the left-hand edge of the form. The area of side strip 130 to the right of tear line 126 and the area of side strip 131 to the left of tear line 128 overlies underlying strip areas of lower sheet 14 which are coated with non-adhesive coating material 49, so that the lower sheet can be peeled away in the strip regions outside tear lines 126 and 128, and the side strips can then be adhered to an item to be mailed. The additional strip region 132 located between tear lines 125 and 128 includes a peel off label 134 which is aligned with a corresponding underlying area of the second sheet which is coated with the non-adhesive coating material. Label 134 may comprise a U.S. Postal Service control label for letter carrier use, carrying the article identification number as well as spaces for receiving the date and sender's name. This can be affixed to a postal service form of the type used to notify a recipient that an attempt was made to deliver a certified mail item, and to inform the recipient where they can pick up the item.

As in the previous embodiment, the detachable areas of the front sheet can be peeled away from the rear sheet because of the non-adhesive coating aligned with these areas, and can be detached from the remainder of the front sheet by means of suitable die cut lines 42 or lines of perforations 126,128 in the case of the side strips 130,131. Additionally, as in the first embodiment, the receipt portion 67 is detachable from the remainder of the form via tear line 22 in addition to tear line 18.

The rear face of the form 110 will be similar to that illustrated in FIG. 5 for the first embodiment, except for the off-center positioning of the return postcard section 124 and the additional side strip 132. The rear sheet can be peeled away from the side strips 130,131 up to the lines of perforations 126,128, and the adhesive backing on strips 130,131 is then used as in the previous embodiments to adhere the return postcard to an item being mailed. On receipt by the addressee, the return postcard portion 124 is detached along the lines of perforations 125 and 128, and the card is mailed back to the sender to confirm receipt.

The form 110 will be manufactured and used in an equivalent manner to that of the first embodiment described above, with the only differences being the provision of additional address label 116 in the upper form portion, the slightly different layout in the central form portion, and the addition of side strip 132 and label 134 in the lower form portion including the return postcard.

FIGS. 8–10 illustrate a mailing form 140 according to another embodiment of the invention, which is designed for situations where no mailing labels or receipts are required. Form 140 is also made from two sheets 141,142 of relatively thin sheet material such as paper stock or lightweight card stock such as lightweight tag. As in the previous embodiments, the rear surface of upper sheet 141 is coated with a layer of adhesive 143, while the upper surface of the lower sheet 142 is coated with a non-adhesive or release coating material 144 in certain areas which are aligned with predetermined detachable or peel-away areas of the upper sheet. The form 140 consists of three identical form parts 145,146,147, each of which has a detachable label 148 which carries a Post Office identifying number, such as a certified mail tracking number. Each form part also includes side strips 149,150 which are aligned with underlying strips 151,152 of the non-adhesive coating material 144.

The three form parts 145,146,147 ere separable from each other by means of transverse tear lines 153,154 or lines of perforations. Alternatively, a suitable cutting device may be used to separate the form parts after printing, and in this case the lines of perforations may be omitted. Each form part includes a return postcard portion 155 which is attachable to an item to be mailed via the adhesively backed side strips 149,150, which can be peeled away from the underlying strips of the rear sheet because of the underlying release coating strips 151,152. Each form part also includes a side portion 156 which carries the identifying number label 148 and which is secured to the return postcard portions via a vertical line of perforations 157. Vertical lines of perforations 158,159 on each side of the return postcard portions 155 may be used to separate the return postcard from the mailed item on delivery to the addressee.

The upper sheet will be die cut along the lines 160 surrounding each of the identifying number labels 148 . The lower sheet is die cut along lines 161,162 underlying the side strips 149,150 so that the lower sheet can be peeled away along these strips to leave the adhesive coating exposed for attaching the return postcard to an item to be mailed, in the same way as described above in the first embodiment.

Preferably, the portions of each form part apart from label carrying portion 156 correspond to a Post Office green return receipt form PS 3811. The front sheet of section 155 will include the appropriate printed indicia and areas for receiving the appropriate information, as in the previous embodiments, and like reference numerals have been used for like parts of the form. The rear face of the form section 155 will be identical to that of the form part 84 of the first embodiment.

The upper and lower sheets of the form in all of the regions of the form which are outside the areas of the lower sheet coated with release material 144 will be permanently secured together into an integral structure. The overall thickness of the form will be such that it can be used in a laser printer, so that the user can enter a series of names and addresses at a computer terminal, or download names and addresses from memory, in order to print them onto successive form parts 145,146 and 147 and successive form sheets. This will considerably speed up the procedure for certified mailing of a large number of items or envelopes. Once printed, the form can be separated into three separate form parts. The certified mail number label 148 on each form part is peeled off and suitably applied to successive items to be mailed, while the side parts 156 are detached along tear line 157 and discarded. The strips of the rear sheet outside die cut lines 161 and 162 are peeled away, and each return postcard 155 is secured via the exposed marginal portions of adhesive backing side strips 149,150 to the appropriate item to be mailed. On receipt by the addressee, the return form part 155 is detached from the item via tear lines 158 and 159, and mailed back to the sender to confirm receipt.

This form provides a convenient and inexpensive way to prepare certified mail items using a laser printer. It will considerably reduce the amount of time needed to prepare such items for mailing.

Figure 12:
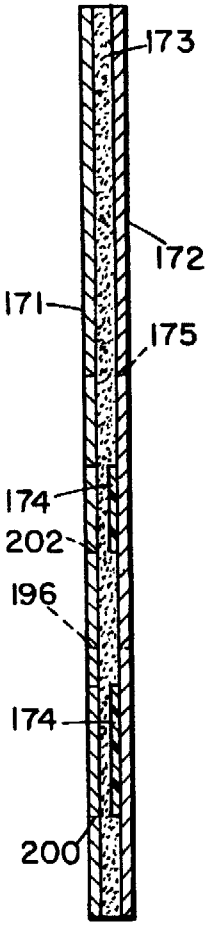
FIG. 12 is a section on the lines 12—12 of FIG. 11.
Figure 11:
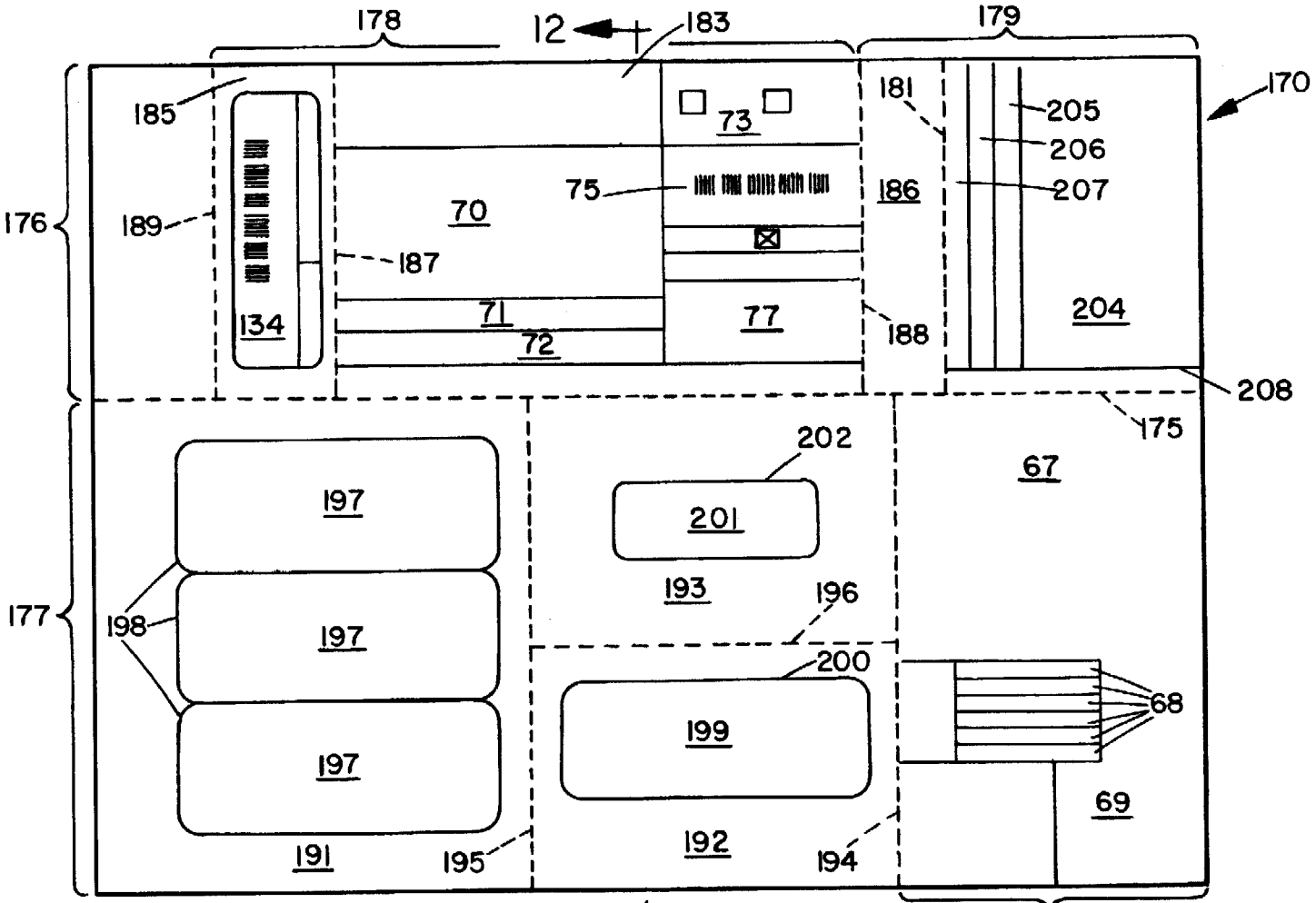
FIG. 11 is a top plan view of a form according to another embodiment of the invention.

FIGS. 11 and 12 illustrate a two layer form 170 according to another embodiment of the invention, which includes the same basic form parts as in the second embodiment but with a different layout. In this embodiment, rather than the form parts and labels being laid out transversely across the form sheet and separated by transverse tear lines as in the first embodiment, the various form parts are laid out lengthwise along the sheet and separated by a longitudinal tear line and transverse tear lines.

As in the previous embodiments, the form 170 comprises an upper sheet 171 and a lower sheet 172. The upper sheet has a coating 173 of adhesive material for securing the upper sheet to the lower sheet in all areas except for predetermined regions of the lower sheet which are coated with a non-adhesive or release material 174 such as silicone gel, whereby the front sheet is not permanently adhered to the rear sheet in these specific regions.

The form 170 may be separated lengthwise along a first, longitudinal line of perforations 175 into portions 176,177. Portion 176 includes a return postcard section 178 and a label carrying portion 179 separable from the section 178 via a transverse line of perforations 181. The remainder of portion 176 includes a return postcard 183 with side strips 185,186 separable from the return postcard along perforation lines 187,188 extending transverse to line 175. Another line of perforations 189 is provided on the opposite side of strip 185 parallel to line 187, to remove an unused end portion of the form portion 176.

Form portion 177 includes a receipt portion 190 identical to receipt portion 60 of the first embodiment but oriented perpendicular to portion 60, and like reference numerals have been used for like parts of the receipt portions. Portion 177 also includes label carrying portions 191,192,193. Receipt portion 190 is separable from the remainder of the form portion 177 via perforation line 194 extending transverse to line 175. The label carrying portion 191 is separable along parallel perforation line 195 from the portions 192 and 193, which can then be separated along perforation line 196 extending transversely between lines 194 and 195.

Label carrying portion 191 carries three identical address labels 197 which are separable from the remainder of the sheet 171 via die cut lines 198, and which are aligned with regions of the lower sheet coated with release coating 174 so that the labels may be peeled off. The adhesive layer 173 coating the rear faces of labels 197 may then be used to adhere the labels to an item to be mailed, a records sheet, a billing sheet, or the like. Label carrying portion 192 carries another separable address label 199 aligned with a region of release coating 174 on the lower sheet and separable from the front sheet along die cut line 200. This can be used for keeping records of items mailed, in an equivalent manner to label 36 of the first embodiment described above. Label carrying portion 193 carries a removable label 201 which carries the Post Office identifying number for the mailing service used, such as Certified Mail. Label 201 is equivalent to label 119 of the second embodiment described above, and is also aligned with a region of release coating 174 on the lower sheet, and separable from the upper sheet along die cut line 202.

Return postcard 183 is identical to the return postcards 60 of the first embodiment, 124 of the second embodiment, and 155 of the third embodiment, and like reference numerals have been used for like parts as appropriate. The side strips 185 and 186 on each side of postcard 183 are aligned with corresponding strips of release coating 174 on the underlying lower sheet 172, as in the previous embodiments, and appropriate die cut lines in the lower sheet in the region of the side strips allow the lower sheet portions underlying the side strips to be peeled away, as in the previous embodiments, so that the side strips may be adhered to an envelope or package. The return postcard and side strips will first be separated from the remainder of the form along tear lines 175,181 and 189. As in the second embodiment, one of the side strips may carry a detachable label 134 for use by a mail carrier in the event that an item of certified mail cannot be delivered, as described above in connection with the embodiment of FIGS. 6 and 7. The lower sheet 172 will have a region coated with release coating 174 underlying label 134, and label 134 hit a die cut periphery to permit it to be peeled away from the side strip if needed.

Portion 179 of the form carries a removable certified mail label 204 which carries the Post Office number for identifying the item of mail. This is equivalent to the label 38 of the first embodiment, the label 118 of the second embodiment, and labels 148 of the third embodiment. Three narrow labels 205,206,207 carrying informational indicia such as "Return Receipt Requested", "Addressee's Address" and "Restricted Delivery", for informing the post office carrier of the conditions under which the item is to be delivered, are located adjacent label 204. The label 204 may also be imprinted with a patch of suitable identifying compound or ink, such as taggant ink, which can be used in automatic mail sorting machines to pick out certified mail items. The labels 204,205,206,207 are aligned with regions of the lower sheet coated with release coating 174, and have die cut peripheral edges 208 so that they may be peeled off and adhered to an item to be mailed.

As in the previous embodiments, the blank areas of form 170 will be imprinted by a laser printer with the addressee's name and address and any other appropriate information, and the form will then be separated into its various parts for use in preparing an item for certified mail and keeping records of the mailing. The various lines of perforations used to separate the form parts may be eliminated in alternative embodiments, and the form may instead be cut into its various parts after printing, using a suitable cutting device. The only lines of perforations which are required in this case are the lines 184 and 185 used to detach the return postcard 181 when the item of mail is delivered.

Although the procedure described above involves use of separate, single forms in a stack as used by certain printers such as laser printers, it will be understood that the same, two-sheet form may be used in a continuous format for the type of printer which has a continuous paper feed. In this case, successive form lengths will be releasably secured together via transverse lines of perforations, and the form will have detachable margins containing pin feed perforations for engagement with the printer feed, as in my U.S. Pat. No. 5,190,210 referred to above.

The mailing form described above will considerably reduce the time needed to prepare items for certain specialized mailing procedures such as certified mail. All the labels needed both for addressing the item, addressing a confirmation copy, and providing a billing or mailing record copy, are provided on the same form in an easily detachable fashion. The return postcard is of two layer paper stock, avoiding the need to use relatively thick card stock which cannot be conveniently integrated with paper forms, or fed through a laser printer or other printers which will not take such stock. With this invention, the same form also contains other documents needed for special mailing procedures, including the receipt, the mail identifying number label, and labels concerned with other, optional services. The computer is programmed to print the addressee address on the mailing labels, billing or record labels, and the return postcard in the same printing stage, in a quick and convenient manner. Thus, these labels do not have to be prepared separately on a manual typewriter or the like as was necessary in the past. Mail preparation is thereby made faster and more efficient than was previously possible. Manual entry of mailing records in a record book is also not necessary with this form, which provides labels which can be simply peeled away from the form and adhered in the appropriate place in the mail record book.

Although some preferred embodiments of the invention have been described above by way of example only, it will be understood by those skilled in the field that modifications may be made to the disclosed embodiments without departing from the scope of the invention, which is defined by the appended claims.

I claim:

1. A mailing form, comprising:

first and second superimposed sheets, each sheet having an inner face facing the other sheet and an outer face;

the first sheet having a plurality of detachable areas which are detachable from the remainder of the first sheet, each detachable area having an adhesive backing facing said second sheet;

the first and second sheets being permanently secured together over predetermined, adhered areas of said form;

the second sheet having predetermined, non-adhered areas on its inner face which are aligned with the detachable areas of the first sheet, the non-adhered areas being covered with a non-adhesive coating on the inner face facing said first sheet;

at least one portion of said form including one of said adhered areas being detachable from the remainder of the form to provide a predetermined mailing form part, each of the sheets having predetermined printed indicia on its outer face in said one adhered portion;

the inner face of the first sheet being coated with a layer of adhesive material for securing the first sheet to the second sheet, the adhesive layer in said detachable areas comprising said adhesive backing; and the form having at least one tear line for detaching said one portion of the form from the remainder of the form, said portion including a pair of second tear lines extending perpendicular to said one tear line for detaching a part of said mailing form part from the remainder of said portion, and side strips on opposite sides of said portion outside said tear lines, the inner face of said second sheet being coated with non-adhesive material in said side strips.

2. The form as claimed in claim 1, wherein said one adhered area comprises a return postcard having printed indicia on both of its faces, including marked areas for receiving predetermined information concerning a mailed item, one of said areas on the outer face of said first sheet comprising an addressee area for receiving the address to which the item is to be mailed.

3. The form as claimed in claim 1, wherein each sheet is of paper stock.

4. The form as claimed in claim 3, wherein the combined thickness of said sheets is no less than 0.007 inches.

5. The form as claimed in claim 4, wherein the sheets are of equal thickness.

6. The form as claimed in claim 4, wherein the first sheet is thinner than the second sheet.

7. The form as claimed in claim 4, wherein the first sheet is thicker than the second sheet.

8. The form as claimed in claim 1, including a plurality of tear lines extending through both sheets of the form and a plurality of die cut lines extending through only the first sheet of the form.

9. The form as claimed in claim 1, wherein the first sheet has a plurality of die cut lines defining said detachable areas.

10. The form as claimed in claim 1, wherein each side strip of said second sheet has a third tear line extending parallel to said first tear line for detaching part of each side strip from said portion to expose said adhesive material for adhering the portion to an item to be mailed.

11. The form as claimed in claim 1, wherein said detachable areas include at least two identical address labels for receiving an address to which an item is to be mailed.

12. The form as claimed in claim 11, wherein said detachable areas include three identical address labels.

13. The form as claimed in claim 1, wherein said detachable areas include at least one identifying number label for identifying and tracking a mailed item.

14. A mailing form, comprising:

first and second superimposed sheets, each sheet having an inner face facing the other sheet and an outer face;

a layer of adhesive material between the inner faces of said sheets;

the inner face of the second sheet being coated with a non-adhesive material in predetermined coated areas of said inner face whereby the first sheet is adhered to the second sheet only in adhered areas outside said coated areas;

the sheets having tear lines extending through both sheets whereby sections of the form can be separated from one another;

the first sheet having tear lines extending through only the first sheet around predetermined non-adhered areas of the first sheet whereby said non-adhered areas can be detached from the remainder of the form, said non-adhered areas including labels for attaching to an item to be mailed;

at least one of said separable form sections including an adhered area and comprising a predetermined mailing form part, each of said sheets having printed indicia on its outer face at least in said one form section;

the form having a first tear line for detaching a portion of the form from the remainder of the form, said portion including said predetermined mailing form part and an additional part, said portion including at least three tear lines extending transverse to said first tear line, including a second tear line for detaching said additional part from said mailing form part, and a pair of tear lines for defining a central portion between said tear lines and side strips on opposite sides of said central portion outside said tear lines, the inner face of said second sheet being coated with non-adhesive material in said side strips.

15. The form as claimed in claim 14, wherein one of said non-adhered label areas is located in one of said side strips.

16. The form as claimed in claim 15, wherein said one label area carries identifying insignia for identifying an item to be mailed.

17. The form as claimed in claim 16, wherein a second non-adhered label area carries the same identifying insignia as said one label area.

18. The form as claimed in claim 14, wherein said form has three identical form sections separable along two, parallel spaced tear lines, each of said form sections including one of said predetermined mailing form parts, the central portion of each mailing form part comprising a return postcard having printed indicia on both of its faces, including marked areas for receiving predetermined information concerning a mailed item, one of said areas on the outer face of said first sheet comprising an addressee area for receiving the address to which an item is to be mailed.

19. The form as claimed in claim 18, wherein each of said form sections includes said additional part, and said additional part includes a non-adhered area comprising a label carrying identifying insignia for identifying an item of mail.

20. The form as claimed in claim 19, wherein said labels on said three form sections carry consecutive identifying numbers.

21. The form as claimed in claim 14, wherein said sheets are rectangular and said first tear line extends longitudinally along said form.

22. A mailing form, comprising:

first and second superimposed sheets, each sheet having an inner face facing the other sheet and an outer face, the sheets being rectangular and having opposite side edges and opposite upper and lower edges;

a layer of adhesive material coating the entire inner face of the first sheet;

the first sheet having a plurality of detachable, nonadhered areas which are detachable from the remainder of the first sheet;

the first and second sheets being permanently secured together over predetermined, adhered areas of the form;

the second sheet having predetermined, non-adhered areas on its inner face which are aligned with said detachable areas of the first sheet, the non-adhered areas being covered with a non-adhesive coating, whereby the first sheet is permanently adhered to the second sheet only in areas outside said non-adhered areas;

the first sheet having printed indicia on its outer face defining at least two separate form parts and a separation region between said form parts extending across the entire sheet between opposite edges of said sheet;

one of said form parts including a mailing form portion for attachment to an item to be mailed, the mailing form portion including a central, return postcard and side strips on opposite sides of the central postcard, and having a pair of tear lines extending transverse to said separation region for separating each side strip from said return postcard; and the inner face of said second sheet being coated with non-adhesive material in said side strips.

* * * * *

US005664725B1

REEXAMINATION CERTIFICATE (3673rd)

United States Patent [19] [11] B1 5,664,725

Walz [45] Certificate Issued Nov. 17, 1998

[54] MAILING FORM

[75] Inventor: Gerard F. Walz, Fallbrook, Calif.

[73] Assignee: Walz Postal Solutions, Inc., Fallbrook, Calif.

Reexamination Request:
No. 90/004,940, Mar. 13, 1998

Reexamination Certificate for:

| | |
|---|---|
| Patent No.: | **5,664,725** |
| Issued: | **Sep. 9, 1997** |
| Appl. No.: | **610,497** |
| Filed: | **Mar. 4, 1996** |

Related U.S. Application Data

[63] Continuation-in-part of Ser. No. 227,513, Apr. 14, 1994, Pat. No. 5,501,393.

[51] Int. Cl.[6] ..... B65D 27/06

[52] U.S. Cl. ..... 229/92; 229/300; 229/92.8; 40/638

[58] Field of Search ..... 229/92, 92.8, 300; 40/638

[56] References Cited

U.S. PATENT DOCUMENTS

| | | |
|---|---|---|
| 2,805,816 | 9/1957 | Morgan . |
| 3,937,492 | 2/1976 | Biron . |
| 3,968,927 | 7/1976 | Katz et al. . |
| 4,368,903 | 1/1983 | Jones . |
| 4,809,905 | 3/1989 | Goodman . |
| 5,183,203 | 2/1993 | Sanders . |
| 5,267,898 | 12/1993 | Doll et al. . |
| 5,316,208 | 5/1994 | Petkovsek . |
| 5,383,686 | 1/1995 | Laurash . |
| 5,486,021 | 1/1996 | Laurash . |
| 5,507,526 | 4/1996 | Petkovsek . |
| 5,573,277 | 11/1996 | Petkovsek . |
| 5,586,788 | 12/1996 | Laurash . |

FOREIGN PATENT DOCUMENTS

| | | |
|---|---|---|
| 1030577 | 5/1978 | Canada . |

OTHER PUBLICATIONS

Paper Direct, Inc., Catalog, Autumn 1993, vol. 4, p. 70.

*Primary Examiner*—Jes F. Pascua

[57] ABSTRACT

A multi-part mailing form has two superimposed sheets of material such as paper stock which are secured together in adhered areas by an adhesive layer between the sheets. The inner face of a lower sheet is coated with a non-adhesive material in certain areas so that the sheets are not adhered in these areas. The coated areas of the lower sheet correspond to detachable areas of the upper sheet which can be detached and secured to an item to be mailed. Sections of the form are separable from one another by cutting or by means of tear lines. One of the separable sections has imprinted indicia on the outer face of each sheet and includes a return postcard for confirming receipt of a mailed item.

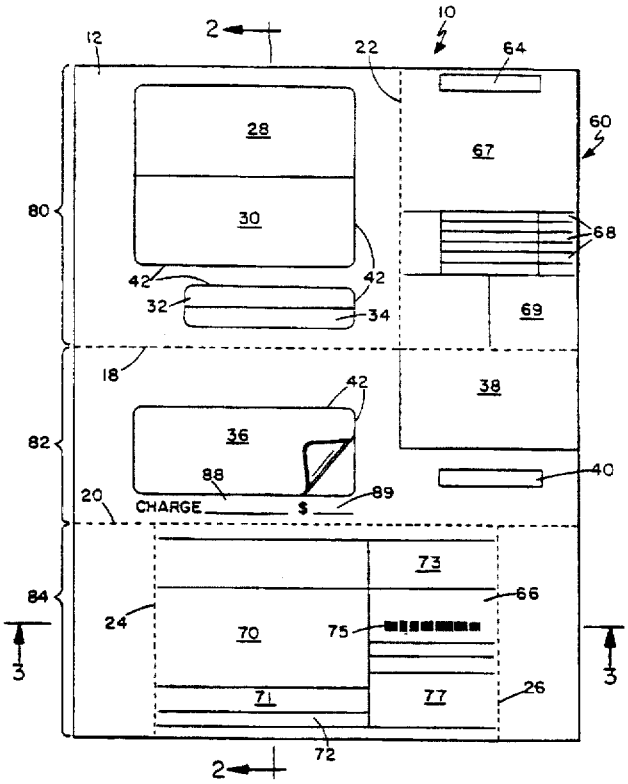

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentablility of claims 1–22 is confirmed.

* * * * *